US005398957A

United States Patent [19]

Leighton et al.

[11] Patent Number: 5,398,957

[45] Date of Patent: Mar. 21, 1995

[54] RECREATIONAL BOOT LENGTH SKI DEVICE

[75] Inventors: Frederick L. Leighton, Falmouth Foreside, Me.; Kenneth C. Shaknites, Danvers, Mass.

[73] Assignee: Morning Sun, Inc., Freeport, Me.

[21] Appl. No.: 131,319

[22] Filed: Oct. 4, 1993

Related U.S. Application Data

[63] Continuation-in-part of Ser. No. 5,209, Feb. 26, 1993, and Ser. No. 7,222, Apr. 15, 1993.

[51] Int. Cl.[6] ..... A63C 5/00

[52] U.S. Cl. ..... 280/600; 36/122

[58] Field of Search ..... 280/600, 841, 11.3, 280/617, 619, 623, 618, 636; 36/122

[56] References Cited

U.S. PATENT DOCUMENTS

| | | | |
|---|---|---|---|
| D. 205,186 | 7/1966 | Koskela et al. | 36/122 |
| 1,886,650 | 11/1932 | Davies et al. | 280/600 |
| 2,154,019 | 4/1939 | Westphal | 280/11.12 |
| 2,946,599 | 7/1960 | Hunsbedt | 280/11.13 |
| 3,879,047 | 4/1975 | MacDonald | 280/600 |
| 3,965,585 | 6/1976 | Stewart | 36/125 |
| 4,004,355 | 1/1977 | Koblick | 36/122 |
| 4,188,046 | 2/1980 | Fleckenstein | 280/618 |
| 4,286,397 | 9/1981 | Booty | 36/132 |
| 4,705,291 | 11/1987 | Gauer | 280/609 |
| 4,779,362 | 10/1988 | Citrowske | 36/132 |
| 4,811,504 | 3/1989 | Bunke | 36/132 |
| 4,836,571 | 6/1989 | Corbisiero | 280/600 |
| 5,078,633 | 1/1992 | Tolbert, Jr. | 441/65 |

*Primary Examiner*—Richard M. Camby

*Attorney, Agent, or Firm*—Daniel H. Kane

[57] ABSTRACT

A recreational boot attachment (10) adapts a boot (50) for sliding on snow, ice, and other natural and artificial surfaces. The ski device is constructed with a boot length flat elongate base (12) having a toe end (14), heel end (15), and flat bottom surface (16) for sliding. The toe end (14) is formed with a toe end brace (18) or bridge spaced above the base (12) defining a recess (20) for receiving a toe end projection of a boot. The toe end brace (18) bears against an upper surface of the toe end projection of the boot. The toe end (14) rises in the front of the elongate base (12) to join the toe end brace (18) and form a toe end plow (22) at the front. A heel end binding (40) is secured to the heel end (15) of the flat elongate base (12). The binding (40) includes first and second pivoting anchors (44,35,36) pivotally mounted on the respective sides of the base (12) spaced from the heel end (15) of the base. A binding strap (42) extends between the pivoting anchors (44) with sufficient length to extend around the heel (48) of a boot (50). The strap (42) can be secured at adjustable lengths between the pivoting anchors. The binding (40) includes a heel piece (55) with a step profile (46) for engaging the heel (48) of a boot (50). The heel piece (55) is formed with at least one channel (56) for mounting the heel piece (55) on the strap (42) above the heel end (15) of the base (12). The heel end binding (40) causes a compression binding force between the heel piece (55) and toe end brace (18) if the heel of a boot tends to separate and the angle between the strap (42) and flat elongate base (12) increases.

18 Claims, 3 Drawing Sheets

RECREATIONAL BOOT LENGTH SKI DEVICE

CROSS REFERENCE TO RELATED PATENT APPLICATIONS

This patent application is a continuation-in-part of the Frederick L. Leighton et al. U.S. Design patent application Ser. No. 29/005,209, filed Feb. 26, 1993, pending, for RECREATIONAL BOOT ATTACHMENT and U.S. Design patent application Ser. No. 29/007,222, filed Apr. 15, 1993, pending, with the same title. All the related patent applications are assigned to a common assignee.

TECHNICAL FIELD

This invention relates to a new recreational boot attachment in the form of a boot length ski-like structure, adapting the boot for sliding on snow, ice, sand, Astroturf TM surfaces, and other natural and artificial surfaces. The invention provides a unitary molded ski structure that provides efficient sliding, toughness for use on a variety of terrains, durability, and binding capability. The invention also provides a new compression binding which increases compression binding force against the heel and toe of a boot, holding the boot length ski device in place, when the heel of the boot tries to separate from the boot length ski structure.

BACKGROUND ART

A variety of "short" skis have been developed for clamping onto boots and for providing a sliding surface much shorter than standard length skis. Generally, such skis are longer than the length of the boots but shorter than regulation skis for ease of carrying and backpacking, for emergency descent, or simply for recreational use. For example, the Fleckenstein U.S. Pat. No. 4,188,046 describes a "short ski" longer than the length of a ski boot for "hotdogging" and fancy skiing. The short skis are fitted with regular ski boot bindings. The Fleckenstein short ski therefore bears resemblance to a "scaled down" ski. Another short ski for stunt skiing is described in the Gauer U.S. Pat. No. 4,705,291. A disadvantage of such short skis is that the ski length may still be difficult to manage in small packs during carrying, and the binding is bulky and heavy.

Shorter skis or ski like surfaces for attachment to boots are also described, for example, in the U.S. Design Pat. No. Des. 205,186, the Davies et al. U.S. Pat. No. 1,886,650, the Corbisiero U.S. Pat. No. 4,836,571, the Koblick U.S. Pat. No. 4,004,355, the MacDonald U.S. Pat. No. 3,879,047, the Hunsbedt U.S. Pat. No. 2,946,599 and the Westphal U.S. Pat. No. 2,154,019. Such devices are sometimes referred to as "snow skates" or "ice skis". A disadvantage of these short ski configuration attachments is that they do not appear suited for rough terrain with a tough and durable construction. Furthermore the bindings do not appear capable of withstanding the applied forces that may occur on steep slopes or rough terrain.

Marty Keller, Inc. of Golden, Colo. manufactures a short ski, longer than the length of the ski boot with a simple stiff wire binding on the toe and heel. Similarly, this stiff wire clamp binding does not appear suitable for matching the forces that may be applied on the ski boot and boot attachment ski device during downhill skiing and sliding travel.

OBJECTS OF THE INVENTION

It is therefore an object of the present invention to provide a new recreational boot attachment that provides a boot length ski-like structure that is easily carried in a small pack, is light in weight, and does not require a bulky conventional ski binding.

Another object of the invention is to provide a new compression binding for a boot length ski device which increases binding force against the toe and heel end of a boot, holding the boot length ski device in place, if the heel of a boot starts to separate from the ski attachment.

A further object of the invention is to provide a boot length ski like structure that adapts the boot for sliding on snow, ice, sand, Astroturf TM surfaces and other natural and artificial surfaces, and which is tough and durable with binding capability matching the forces imparted by steep slopes or rough terrain.

DISCLOSURE OF THE INVENTION

In order to accomplish these results the present invention provides a boot length recreational ski attachment, adapting the boot for sliding on snow, ice, and other natural and artificial surfaces. A flat elongate base substantially the length of a boot is constructed with a toe end, heel end, and flat bottom surface for sliding. The toe end is formed with a toe end brace spaced above the base defining a recess between the base and toe end brace for receiving a toe end projection of a boot. The toe end brace bears against an upper surface of the toe end projection of the boot. The toe end rises in the front of the elongate base to join the toe end brace and form a toe end plow or rounded surface at the front of the elongate base for efficient sliding over snow, ice, and other surfaces.

The invention also provides a heel end binding secured to the heel end of the flat elongate base. The binding includes first and second pivoting anchors pivotally mounted on the respective sides of the base spaced from the heel end of the base. A binding strap extends between the pivoting anchors with sufficient length to extend around the heel of a boot at the back of the boot. The strap is pivotable on the pivoting anchors between greater and lesser angles with respect to the flat elongate base. The strap can be secured at adjustable lengths between the pivoting anchors.

According to the invention the binding includes a heel piece with a step profile for engaging the heel of a boot. The heel piece is formed with at least one channel for receiving the binding strap and mounting the heel piece on the strap above the heel end of the base. A feature of the heel end binding is that it causes a compression binding force between the heel piece and toe end brace which increases if the heel of a boot tends to separate from the ski device and the angle between the strap and flat elongate base increases.

In the preferred example the elongate base including heel end, toe end, and toe end brace are formed as a unitary molded piece of plastic polymer resin. An anchor plate is molded into the flat elongate base with first and second anchor plate projections extending from the base. The first and second pivoting anchors are provided by first and second strap anchors pivotally coupled to the respective anchor plate projections. The binding strap is coupled to the strap anchors for pivotal motion of the binding strap to greater and lesser angles relative to the flat elongate base.

Also in the preferred example the first and second strap anchors are formed with return openings such as flat loops for passing the binding strap through each strap anchor and back on itself. The strap thus forms a double layer strap of inner and outer layers around the heel of a boot. For securing the binding strap, the binding strap is formed with complementary hook and loop fastening strips on the respective inner and outer layers of the double layer strap. The inner and outer layers of the double layer strap are therefore secured against each other at the desired length between the strap anchors.

The heel piece in the preferred example is constructed with an internal channel through which the strap inner layer passes for holding the heel piece in place over the heel end of the base. The heel piece is also formed with an exterior groove such as a flat groove with upper and lower edges for receiving the strap outer layer. Thus, both the inner and outer layers of the double layer strap engage the heel piece whose inner surface is formed with the step profile for engaging the heel of a boot.

Other objects, features and advantages of the invention are apparent in the following specification and accompanying drawings.

DESCRIPTION OF PREFERRED EXAMPLE EMBODIMENTS AND BEST MODE OF THE INVENTION

Figure 1:
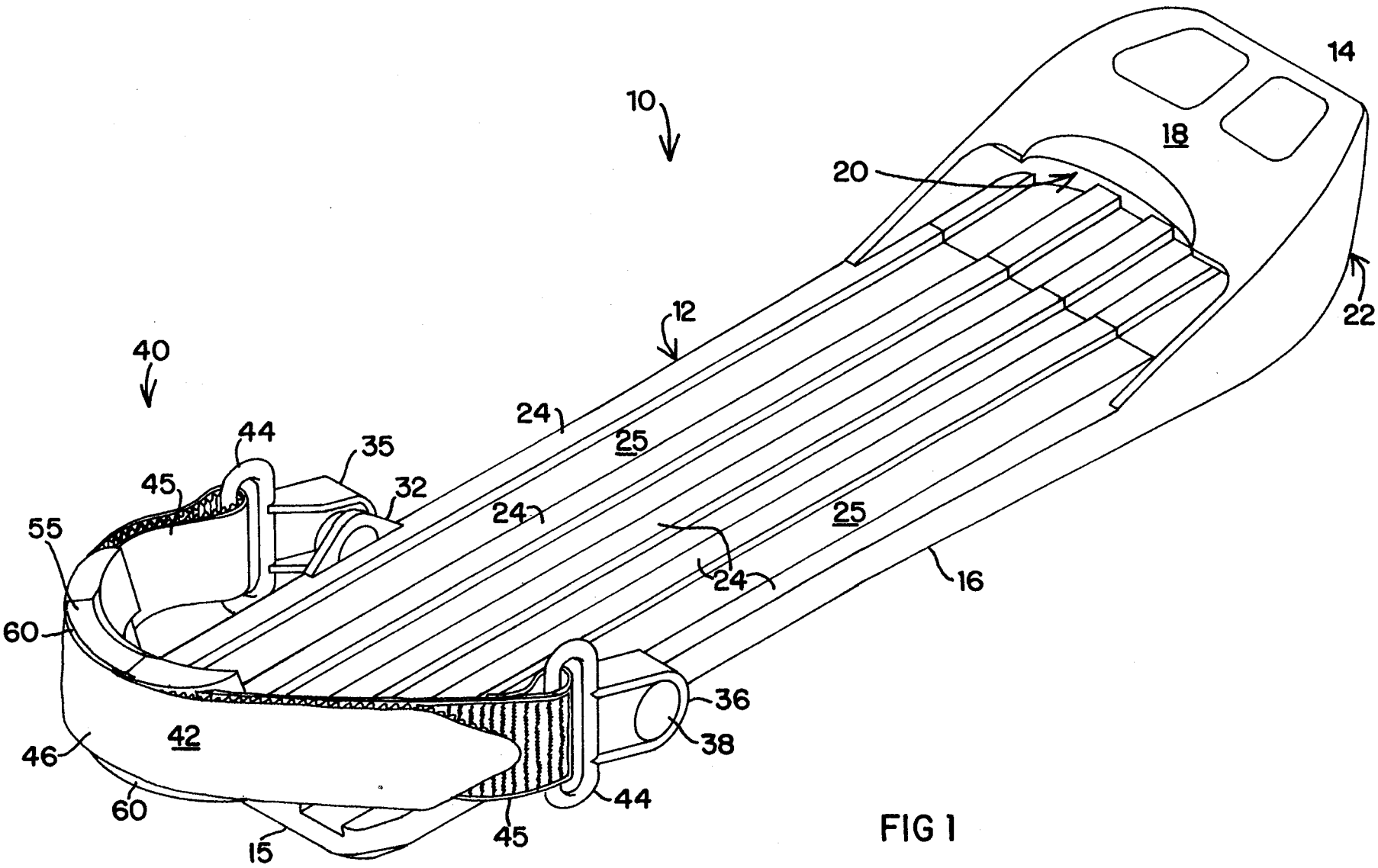
FIG. 1 is a perspective view of the boot length recreational ski device according to the invention.

A boot length ski device suitable for attachment to a boot according to the invention is illustrated in FIGS. 1–4. The flat elongate base 12 is substantially the length of a boot such as a ski boot or telemark boot, and is formed with a toe end 14, heel end 15, and flat bottom surface 16 for sliding. The toe end 14 is formed with a toe end brace or bridge 18 spaced above the base 12. The bridge 18 and base 12 define a recess or indentation 20 between the base 12 and toe end brace 18 for receiving a toe end projection of a boot. The toe end 14 rises in the front of the elongate base 12 to join the toe end brace 18 and form a toe end plow 22 or rounded front end for smooth travel over snow and other surfaces.

Figure 2:
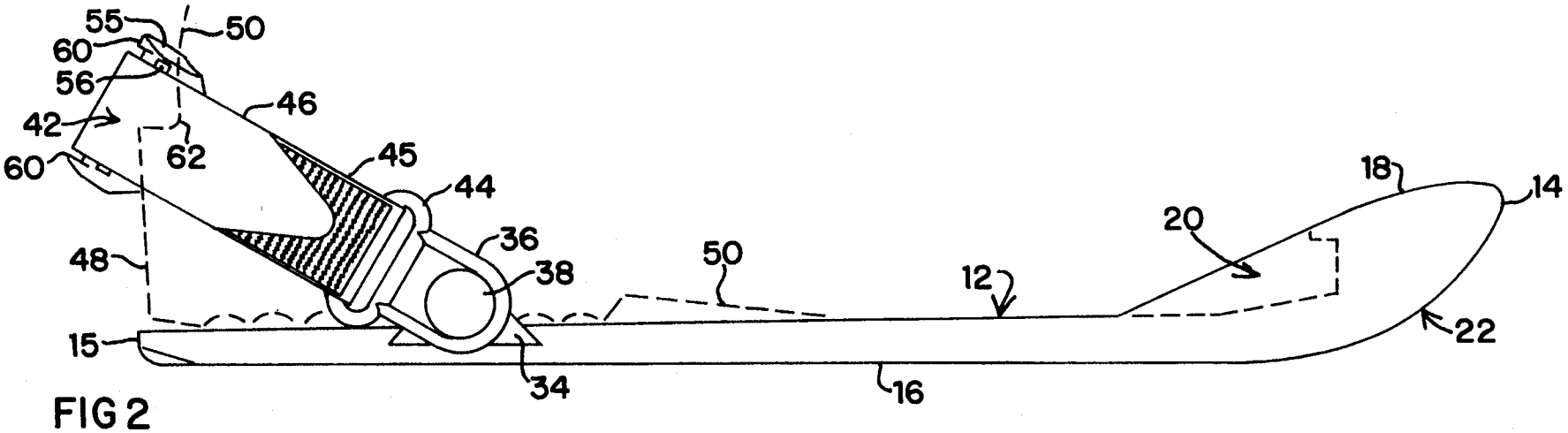
FIG. 2 is a side elevation view of the boot length ski device showing in fragmentary dashed outline a boot secured in the binding, the step profile of the inside surface of the compression binding heel piece, and the toe end recess at the front of the ski device.
Figure 3:
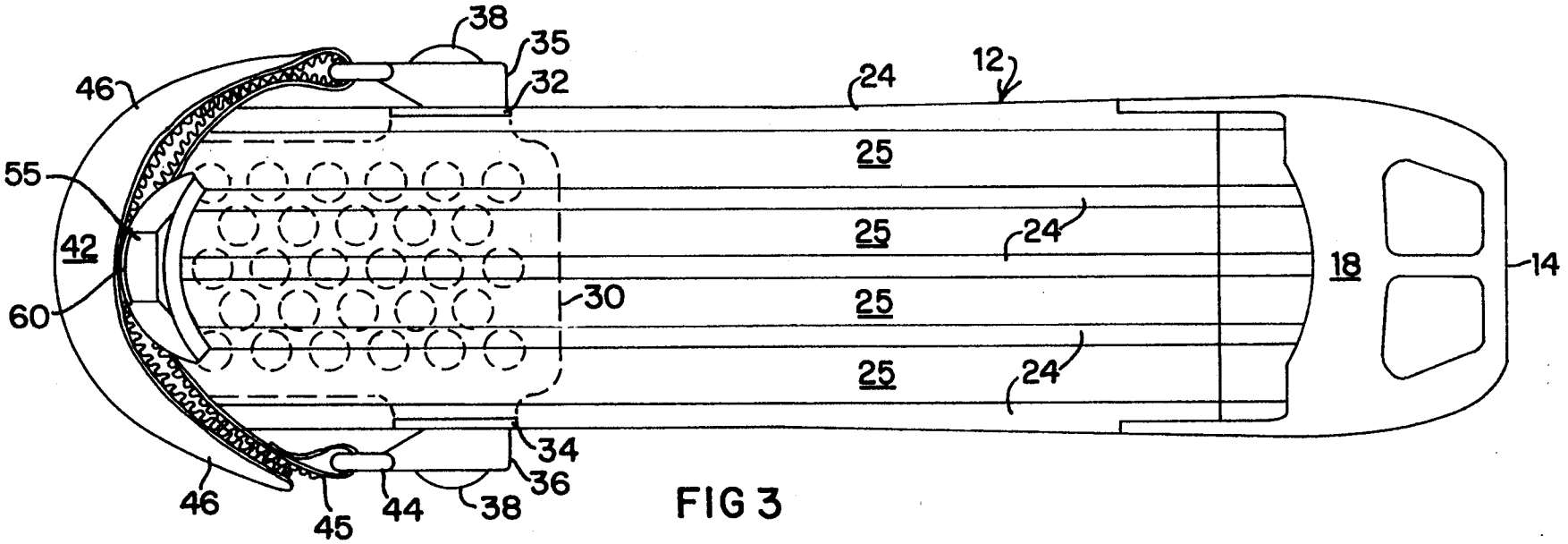
FIG. 3 is a plan view of the boot length ski device showing in dashed outline the position of the embedded anchor plate.
Figure 4:
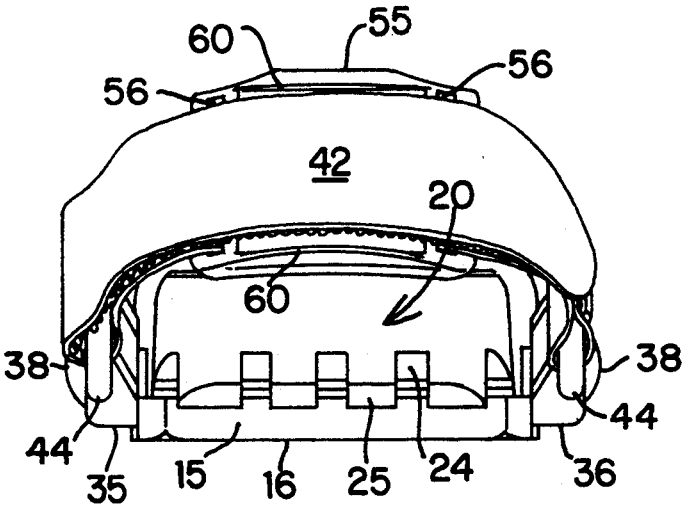
FIG. 4 is rear elevation view of the boot length ski device showing the lands and grooves formed on the base and sloping to the heel end.

While the bottom surface 16 of the flat elongate base 12 provides a smooth sliding surface, the top of the base 12 is formed with alternating lands 24 and grooves 25. As shown in FIGS. 1–4 the elongate lands 24 and grooves 25 extend from the toe end of the base 12 to the heel end 15 where the grooves are open for drainage. The elongate lands 14 and grooves 25 taper in a downward slope from the toe end 14 to the heel end 15 as shown in FIGS. 2 and 4. This toe to heel slope or taper of the lands 14 performs an important function in the operation of the boot length ski devices.

Standard ski boots are constructed with a forward taper for use with standard ski lengths. The forward taper assists the skier in shifting weight forward onto the forward portions of normal length skis. For the boot length skis it is desired to shift the weight back in order to keep the toes elevated and prevent "nose diving" by the short length attachments. The front to back rearward taper of the lands of the boot length ski devices facilitates shifting weight to the heel. Thus the rearward tilting lands shift weight back on the heel rather than forward contrary to the effect of conventional ski boot and ski equipment.

Figure 6:
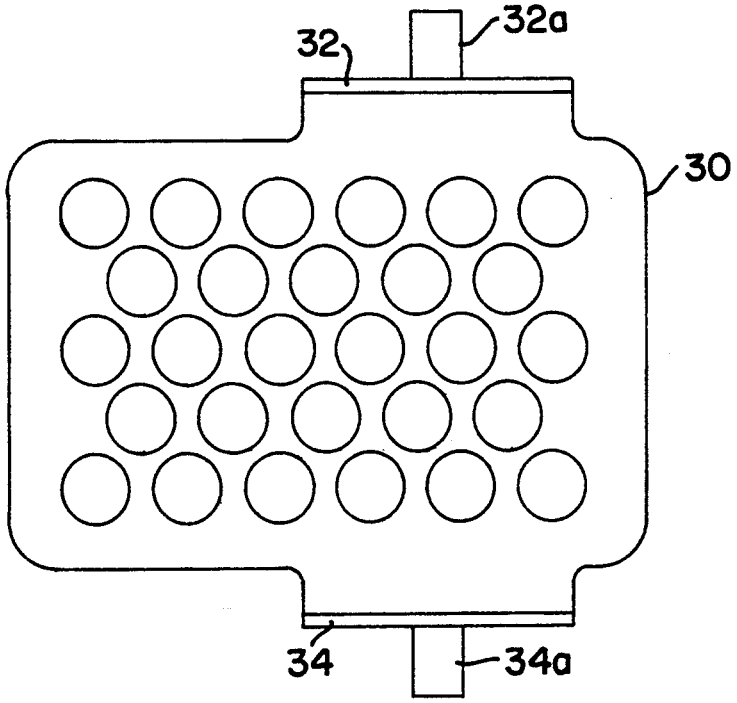
FIG. 6 is a plan view of the compression binding anchor plate and FIG. 6A is a side elevation view of the anchor plate showing the anchor plate projections.
Figure 6A:
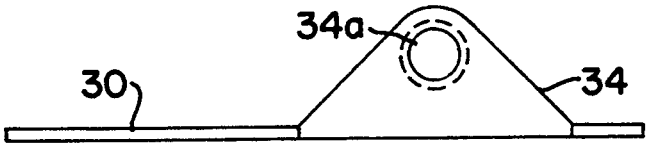

The elongate base 12 including heel end 15, toe end 14, toe end brace 18, flat bottom surface 16 and upper surface lands 24 and grooves 25 can be molded as a unitary molded piece from an appropriate plastic polymer resin such as polyethylene, polypropylene, PVC, ABS, etc. and copolymers and cross polymers. As shown in FIGS. 3 and 6, an anchor plate 30 which extends across the width of the elongate flat base 12 can be molded as an integral part of the unitary molded piece. The anchor plate 30 molded into the flat elongate base 12 is formed with first and second anchor plate projections 32,34 extending at right angles to the anchor plate 30 in the upward direction. The anchor plate projections 32,34 provide the fixed coupling for pivotally coupling the binding strap as hereafter described.

The heel end binding 40 is secured to the heel end 15 of the flat elongate base 12 by pivotally coupling to the anchor plate projections 32,34. The pivotal mounting can be accomplished by welding steel axles **32*a*,34*a* to the anchor plate projections 32,34 and sliding annular plastic bearings 35 and 36 over the axles. The axles 32*a*,34*a* extend laterally outward at the sides of the base 12. The pivotally mounted plastic bearings 35,36 are retained on the anchor plate projection axles 32*a*,34*a* by retaining caps 38**.

A binding strap 42 extends between pivoting strap anchors pivotally coupled to the anchor plate projection axles by the plastic bearings 35,36. The pivoting strap anchors may be for example flat loops 44 which provide return openings for passing the binding strap 42 through each pivoting strap anchor loop 44 and back on itself. The strap thus forms a double layer strap with an inner layer 45 and an outer layer 46 secured around the heel 48 of a boot 50. As shown in FIGS. 2 and 3 the binding strap is formed with complementary hook and loop fastening strips such as complementary Velcro TM strips on the respective inner and outer layers 45,46. The inner and outer layers 45,46 are therefore secured against each other at the desired length between the strap anchor loops 44.

Figure 5:
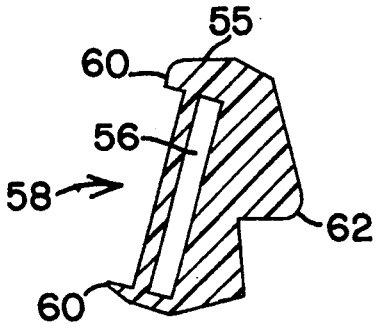
FIG. 5 is a side cross section view through the center of the compression binding heel piece.

The heel end compression binding 40 also includes a heel piece particularly shown in FIGS. 2 and 5. The heel piece 55 is formed with an internal channel 56 through which the inner layer 45 of the binding strap 42 passes for holding the heel piece 55 in place over the heel end 15 of the base 12. The heel piece 55 is also formed with an exterior groove 58 with upper and lower edges 60 for receiving the outer layer 46 of strap 42. The inner surface of the heel piece 55 is formed with a step profile 46 for engaging the heel 48 of boot 50.

The length of the strap 42 is then adjusted and the inner and outer layers 45,46 are secured together for a snug fit of the binding 40 against the heel end of the boot. At the same time the projecting sole or other toe end projection of the boot is secured in place in the recess 20 at the toe end of the boot. The toe end brace or bridge 18 bears against the upper surface of the toe end projection. While the inner and outer layers 45,46 of binding strap 42 are conveniently secured together by complementary hook and loop fastening strips, a variety of other fasteners may also be used to secure the binding strap at a desired length including buckles, clamps, etc.

As is apparent in FIG. 2, if the heel 48 of boot 50 tends to separate from the base 12 the angle between the binding strap 42 and elongate base 12 increases. As the angle between the strap 42 and elongate base 12 increases, the heel end binding 40 and in particular the heel piece 55 in cooperation with the toe end recess 20 and toe end brace 18 increases the compression binding force between the heel piece 55 and toe end brace 18 so that the boot length ski device 10 is held even more securely in place on the boot 50. This effect can be analyzed as follows.

The secured length of the heel binding strap 42 gives a fixed radius of turning with respect to the binding posts 32*a* and 34*a*. However the turning radius of the boot from toe to heel is substantially greater. As a result, any lifting of the heel "tries" to elongate the binding strap 42. This forces the heel 48 forward and the toe into the toe bridge 18, increasing the horizontal compression force of the binding on the boot 50. Thus, lifting force or rising force is converted into horizontal compression binding force.

While the invention has been described with reference to particular example embodiments it is intended to cover all modifications and equivalents within the scope of the following claims.

We claim:

1. A recreational boot attachment, adapting a boot for sliding on snow, ice, and other natural and artificial surfaces, comprising:

a flat elongate base substantially the length of a boot having a toe end, heel end, and flat bottom surface for sliding, said toe end being formed with a toe end brace spaced above the base and defining a recess between the base and toe end brace for receiving a toe end projection of a boot with the toe end brace bearing against an upper surface of the toe end projection of the boot, said toe end rising in the front of the elongate base to join the toe end brace and form a toe end plow at the front of the elongate base;

a heel end binding secured to the heel end of the flat elongate base, said binding comprising first and second pivoting anchors pivotally mounted on the respective sides of the base spaced from the heel end of the base, and a binding strap extending between the pivoting anchors with sufficient length to extend around the heel of a boot at the back of the boot, said strap being pivotable on the pivoting anchors between greater and lesser angles with respect to the flat elongate base, said strap comprising adjustable strap securing means for securing the strap at adjustable lengths between the pivoting anchors;

said binding comprising a heel piece with a step profile for engaging the heel of a boot, said heel piece being formed with at least one channel for receiving the strap and mounting the heel piece on the strap above the heel end of the base;

whereby the heel end binding causes an increase in compression binding force between the heel piece and toe end brace if the heel of a boot tends to separate from the base and the angle between the strap and flat elongate base tends to increase.

2. The recreational boot attachment of claim 1 wherein the elongate base including heel end, toe end, and toe end brace are formed as a unitary molded piece.

3. The recreational boot attachment of claim 2 wherein the first and second pivoting anchors comprise an anchor plate molded into the flat elongate base with first and second anchor plate projections extending from the base, and first and second strap anchors pivotally coupled to the respective anchor plate projections, said binding strap being coupled to the strap anchors for pivotal motion of the binding strap to greater and lesser angles relative to the flat elongate base.

4. The recreational boot attachment of claim 3 wherein the first and second strap anchors comprise return opening for passing the binding strap through each strap anchor and back on itself to form a double layer strap of inner and outer layers around the heel of a boot.

5. The recreational boot attachment of claim 4 wherein the binding strap is formed with complementary hook and loop fastening strips on the respective inner and outer layers of the double layer strap for securing the inner and outer layers of the double layer strap against each other at the desired length between the strap anchors.

6. The recreational boot attachment of claim 4 wherein the heel piece comprises an internal channel through which the strap inner layer passes for holding the heel piece in place over the heel end of the base, said heel piece being formed with an exterior groove with upper and lower edges for receiving the strap outer layer.

7. The recreational boot attachment of claim 1 wherein the pivoting anchors comprise return openings in the form of flat loops for passing the binding strap through each pivoting anchor and back on itself to form a double layer strap of inner and outer layers around the heel of a boot.

8. The recreational boot attachment of claim 7 wherein the heel piece comprises an internal channel through which the strap inner layer passes for holding the heel piece in place over the heel end of the base, said heel piece being formed with an exterior groove with upper and lower edges for receiving the strap outer layer.

9. The recreational boot attachment of claim 8 wherein the binding strap is formed with complementary hook and loop fastening strips on the respective inner and outer layers of the double layer strap for securing the inner and outer layers of the double layer strap against each other at the desired length between the pivoting anchors.

10. The recreational boot attachment of claim 1 wherein the flat elongate base is formed with elongate lands and grooves extending from the toe end to the heel end on the upper surface of the flat elongate base, said lands and grooves being open at the heel end of the base for drainage.

11. The recreational boot attachment of claim 10 wherein the lands slope in a downward direction from the toe end to the heel end to facilitate shifting weight of a user back onto the heels.

12. A recreational boot attachment, adapting a boot for sliding on snow, ice, and other natural and artificial surfaces, comprising:

a flat elongate base substantially the length of a boot having a toe end, heel end, and flat bottom surface for sliding, said toe end being formed with a toe end brace spaced above the base and defining a recess between the base and toe end brace for receiving a toe end projection of a boot with the toe end brace bearing against an upper surface of the toe end projection of the boot, said toe end rising in the front of the elongate base to join the toe end brace and form a toe end plow at the front of the elongate base;

a heel end binding secured to the heel end of the flat elongate base, said binding comprising first and second pivoting anchors pivotally mounted on the respective sides of the base spaced from the heel end of the base, and a binding strap extending between the pivoting anchors with sufficient length to extend around the heel of a boot at the back of the boot, said strap being pivotable on the pivoting anchors between greater and lesser angles with respect to the flat elongate base, said strap comprising adjustable strap securing means for securing the strap at adjustable lengths between the pivoting anchors;

said first and second pivoting anchors comprising return openings for passing the binding strap through each pivoting anchor and back on itself to form a double layer strap of inner and outer layers around the heel of a boot;

said binding comprising a heel piece with a step profile for engaging the heel of a boot, said heel piece comprising an internal channel through which the binding strap inner layer passes for holding the heel piece in place over the heel end of the base, said heel piece being formed with an exterior groove with upper and lower edges for guiding and receiving the binding strap outer layer;

whereby the heel end binding causes a compression binding force between the heel piece and toe end brace which increases as the heel of a boot tends to separate from the base and the angle between the strap and flat elongate base increases.

13. The recreational boot attachment of claim 12 wherein the adjustable strap securing means comprises complementary hook and loop fastening strips formed on the respective inner and outer layers of the double layer strap for securing the inner and outer layers of the double layer strap against each other at the desired length between the strap anchors.

14. The recreational boot attachment of claim 13 wherein the elongate base including heel end, toe end, and toe end brace are formed as a unitary molded piece.

15. The recreational boot attachment of claim 14 wherein the first and second pivoting anchors comprise an anchor plate molded into the flat elongate base with first and second anchor plate projections extending from the base, and first and second strap anchors comprising the return openings in the form of flat loops pivotally coupled to the anchor plate projections, said binding strap passing through the flat loops of the strap anchors for pivotal motion of the binding strap to greater and lesser angles relative to the flat elongate base.

16. The recreational boot attachment of claim 15 wherein the first and second anchor plate projections are formed with axles extending laterally outward from the sides of the base, and wherein the first and second strap anchors are pivotally mounted on the respective axles.

17. The recreational boot attachment of claim 15 wherein the flat elongate base is formed with elongate lands and grooves extending from the toe end to the heel end on the upper surface of the flat elongate base, said lands and grooves being open at the heel end of the base for drainage.

18. The recreational boot attachment of claim 17 wherein the lands slope in a downward direction from the toe end to the heel end to facilitate shifting weight of a user back onto the heels.

* * * * *